United States Patent [19]

Hoffart

[11] Patent Number: 4,873,776

[45] Date of Patent: Oct. 17, 1989

[54] HINGED ILLUMINATED SIGN

[75] Inventor: Andrew B. Hoffart, Mission Viejo, Calif.

[73] Assignee: American Display Inc., Rancho Santa Margarita, Calif.

[21] Appl. No.: 264,801

[22] Filed: Oct. 31, 1988

[51] Int. Cl.[4] ..... G09F 13/04

[52] U.S. Cl. ..... 40/572; 40/574

[58] Field of Search ..... 40/574, 572, 578, 549

[56] References Cited

U.S. PATENT DOCUMENTS

| | | | |
|---|---|---|---|
| 3,391,481 | 7/1968 | Lloyd | 40/549 |
| 3,396,483 | 8/1968 | Stein et al. | 48/574 |
| 3,593,448 | 7/1971 | Schoepf et al. | 40/574 |
| 3,863,372 | 2/1975 | Stilling | 40/574 |
| 4,267,657 | 5/1981 | Kloke | 40/549 |
| 4,327,513 | 5/1982 | de Gunzburg | 40/572 |
| 4,452,000 | 6/1984 | Gandy | 40/574 |
| 4,547,987 | 10/1985 | Stilling | 40/574 |

*Primary Examiner*—Gene Mancene
*Assistant Examiner*—Cary E. Stone
*Attorney, Agent, or Firm*—Gordon K. Anderson

[57] ABSTRACT

An illuminated sign which has a body (20) of extruded metal, which is rectangular in shape and held together at mitered corners with brackets (28) engaged into integral grooves (24). A pair of hinged sides are pivotally mounted onto the body, each consisting of an extruded casing (30) and a truncated translucent face (48) held in place by a plurality of retaining copings (56). The face contains raised or recessed indica which may be colored differently than the balance of the face. Lights are supplied inside the sign to allow illumination for visualization at night. The sides are so formed as to hinge on the top, as they are rotatably contained into the body with the other edges held into a locked position with an extended pointed lip (36) making the sign accessible inside and openable without external fastening devices, simplifying construction and service.

7 Claims, 4 Drawing Sheets

HINGED ILLUMINATED SIGN

TECHNICAL FIELD

The present invention relates to outdoor signs in general, and more particularly to illuminated signs with extruded self-latching metal frames and vacuum formed face plates that are hinged for internal access.

BACKGROUND ART

Previously, many different types of structures have been used in endeavoring to provide a cost effective and attractive means for producing an illuminated sign. Generally, outdoor signs having lights inside are fabricated of sheet metal bent or broken into a structured shape to produce the frame. Recently, some prior art has been produced using an extrusion to eliminate costly labor while accomplishing the same purpose and maintaining, or even improving, its appearance. While this type of construction has been available, it has not been entirely successful due to its limited utility and complexity. In most cases the light transmitting sheet is flat and held in place with grooves and gaskets. By contrast, flanged vacuum formed face plates have been lacking, particularly with integral mounting flanges.

A search of the prior art did not disclose any patents that read directly on the claims of the instant invention, however, the following U. S. patents were considered related:

| Patent No. | Inventor | Issue Date |
|---|---|---|
| 4,547,987 | Stilling | Oct. 22, 1985 |
| 4,452,000 | Gandy | Jun. 5, 1984 |
| 4,267,657 | Kloke | May 19, 1981 |
| 3,863,372 | Stilling | Feb. 4, 1975 |
| 3,396,483 | Stein et al | Aug. 13, 1968 |
| 3,391,481 | Lloyd | Jul. 9, 1968 |

Stilling, in U.S. Pat. No. 4,547,987, teaches a sign structure having a hinged member around its perimeter and an outer face frame supporting a flat face panel. The hinge is formed integrally with extrusions with opposed convexly and concavely shaped members retained by a screw. The flat face panel is gasketed, or a flexible material is alternately used for a front panel, which is retained around a wrapping member jamming between a portion of the extrusion and an arm.

Gandy in U.S. Pat. No. 4,452,000 discloses a housing formed of metal extrusions with a front cover holding flexible light transmitting material wrapped in a retainer bar. The front cover hinges upwardly with a rounded portion of the extrusion web received into a rectangular recess in the housing serving as a pivot to allow the cover to open. The housing top and bottom are connected to the sides using L-shaped corner brackets inserted into a U-shaped inner edge and screws are secured in a recess holding the frame together. An alternate embodiment utilizes a sheet metal housing.

Kloke, in U.S. Pat. No. 4,267,657, again uses extrusions for an outer casing with a C-shaped groove in the perimeter to which a bead on a leg is added. The leg is inserted into the groove allowing a pivotal rotation of about 45 degrees, while beyond that, an angular disposition to about 70–75 degrees is accomplished with the bead disengaged from the groove. Obviously, the leg is part of a front wall to which a flat element containing advertising is retained. It will be noted that little is disclosed about this element, except a raised portion or frame is illustrated on the perimeter. The walls are connected at the corners with L-shaped connector elements, and the corners of the front and rear walls are formed using corner pieces having biforcated ends and teeth.

U.S. Pat. No. 3,863,372 issued to Stilling teaches a sign box which is formed of extrusion members having complimentary mating formations interacting with a concave surface in the extrusion members. A flat translucent element having peripheral strips is nested into the extrusion of the front panel. The corners of the box are held together with gussets having legs that contain a plurality of teeth and are attached with screws that pass therethrough.

Patents of Stein et al and Lloyd are indicative of the art to which this invention pertains for background purposes, however, little relevance is given to their structure.

DISCLOSURE OF THE INVENTION

Outdoor signs that contain indica or symbolic representation have been popular for some time, particularly those that are attractive and illuminated inside making identification of a business establishment or advertisement easy from a distance, particularly at night. In the past, these signs have been fabricated of formed sheet metal, such as steel or aluminum that are, by their very nature, labor intensive requiring large and expensive metal working equipment. It is, therefore, a primary object of the invention to produce a sign that utilizes only four different extrusions of aluminum and two different shapes that interlock together reducing fabrication time and consequently costly labor. The corners are mitered and butted together using the interlocking shapes, producing a frame having sufficient rigidity and structural integrity to withstand wind loading imposed by extreme environmental conditions.

An important object of the invention allows the sign to be hinged on both sides to gain access to the fluorescent lamps inside utilizing an integral hinge that is formed into the extrusions eliminating the need for a separate hinge and necessary attaching hardware. Further, the hinge is self-limiting in the angle of opening and requires no removal of screws, or even a separate latch to facilitate this function. This action is accomplished by the extruded parts containing a clip type interface allowing the sides to simply be closed and held into place under the friction of a lip into a radial cavity.

Another object of the invention allows a choice of sizes to be fabricated utilizing the same extrusions. The size is basically governed by the length of the individual pieces that are cut on a miter by an ordinary metal cutting saw. It has been found that with one size of extrusion a sign up to 14 feet (4.3 meters) in length by 8 feet (2.4 meters) in height may be fabricated with ease and any smaller size may be made provided the proportion is practical.

Still another object of the invention is directed to the use of a vacuum formed face plate in the sign that is attractive and easily produced by forming under heat and negative pressure. Vacuum forming allows a single piece of thermoplastic to be molded into a shape with raised indica on the surface or a design formed integrally. The thermoplastic material lends itself to this application, as it is easily formulated with translucent optical characteristics allowing illumination using a light source inside and the raised characters may be colored to produce a distinct and sharp variation from the background. As the face plate is a separate entity from the extruded frame, replacement becomes easy if damage occurs by natural forces or vandals, as the plate is held in place by a rectangular retaining coping that is nested into a hinged casing. As the face is interposed between the coping and casing, removal of a plurality of self-tapping screws drops the coping away and the face is exposed.

Yet another object of the invention is the ease of fabrication, as only the four extrusions are mitered at each end with angles placed at the corners and tack welded into place. Since the component parts are assembled simply and the welds hidden, the entire sign may be pretreated and finished prior to assembly or may be painted after fabrication with equal ease. The labor savings in this invention using extrusions that are preshaped, plus the ease of assembly allows the entire sign to be cost effective and yet have a rich, pleasing finished appearance.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
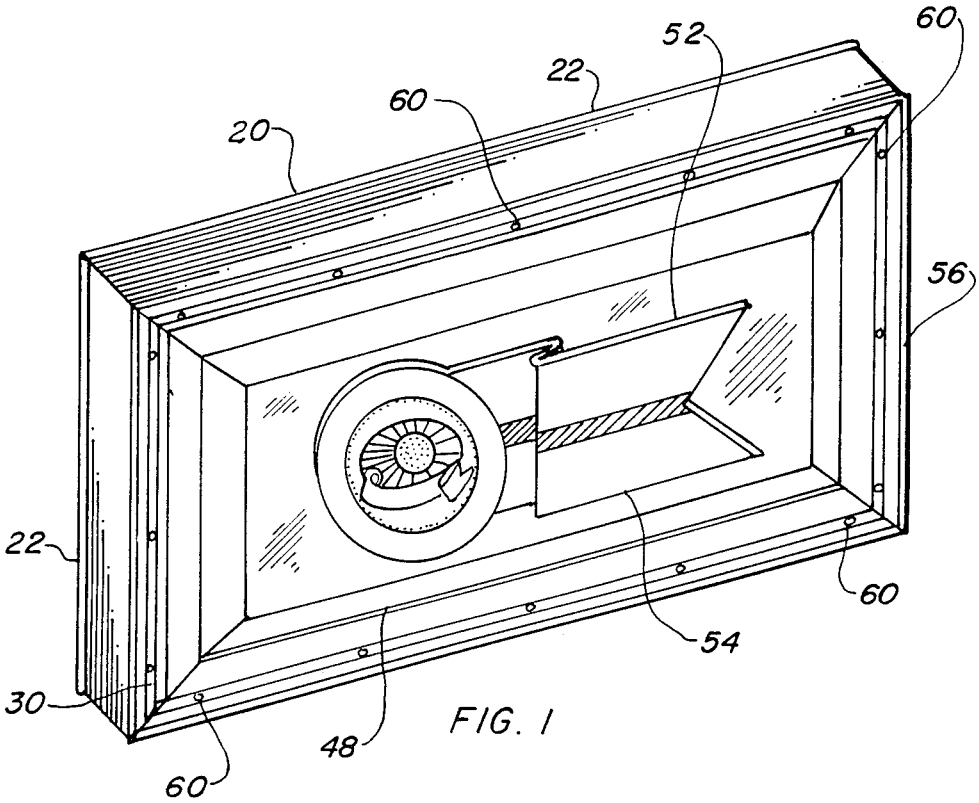
FIG. 1 is a partial isometric view of the preferred embodiment illustrated with a logo type symbol depicting the entire device with a representative image to show where the indica is positioned.

The best mode for carrying out the invention is presented in terms of a preferred embodiment. The preferred embodiment, as shown in FIGS. 1 through 6 is comprised of an extruded rectangular body 20 in the shape of a "U". This body 20, in cross-section as viewed in FIGS. 3 and 5, has a radial socket 22 along the outer edge of each side and a pair of internal recessed angle receiving grooves 24. Further, the shape of this extrusion includes a pair of inwardly depending support legs 26. The body 20 is formed of four separate lengths, mitered on each end, and fitted together with an angle bracket 28, one on each corner, configured to slide tightly into the grooves 24. The angle brackets 28 align each length and form a structurally reinforced joint at the corners allowing the mitered ends to be contiguously mated creating a tight and smooth joint. The brackets 28 are tack welded into place on the inside along the angle receiving grooves 24, so as to not show the effects of the heat on the external surface. The body 20 may be either rectangular or square, depending upon the span of each length with the configuration varying as to the application.

A pair of rectanguar hinged casings 30, slightly smaller in width and length than the body 20, are pivotally attached to each side. Each casing 30 is made of extruded material much like that of the body, except it is relatively flat and contains a face recess 32 and an outwardly extending radial protuberance 34 along the top edge. Only the top piece contains this protuberance 34 with the remaining 3 sides slightly different in that an extended pointed lip 36 is substituted therefore. The protuberance 34 is slightly smaller in diameter than the radial socket 22 of the body 20 and is pivotally positioned inside allowing the casings 30 to be both retained and rotate outwardly from the body 20 for internal access. The casing itself is formed from an upper casing member 38 and a lower casing member 40, also a pair of casing sides 42.

The casing 30 is attached to the body 20 using the radial protuberance 34 in the socket 22 and the balance of the members are assembled using four flat "L" shaped corner brackets 44, one at each corner. The brackets 44 are nested or slid into the casing 30 at a longitudinal recess 46 formed integrally thereinto. These corners are subsequently reinforced being held together with the strength of the corner bracket 44, which is much like the angle bracket 28 of the body 20, except they are flat. The brackets 44 are likewise tack welded into place along the longitudinal recess 46, again away from the outside surface of the sign. This method of attachment produces a strong rigid joint that is simple, yet creates a union that increases the strength of both the parent members, along with the reinforcing bracket 44, since it is both nested into the integral recess 46 and welded with the same material as the structure.

Integral self-latching means are formed by casing members 40 and 42 which contain a pointed lip 36 that engages the radial socket 22 of the body 20, however, instead of rotating, as does the protuberance 34 on the top, they uniformly snap into place holding the hinged casings 30 closed tightly against the body 20. To describe the closing function another way, the snap action is formed by the lip on the casing members 40 and 42, contiguously engaging the body radial socket 22 on the edge of both a first side and a second side retaining the casings 30 in place by frictional resistance, yet allowing opening thereof by the utilization a slight bending moment of the socket 22 creating an interference to latch and yet having sufficient resilience to allow opening. The relationship of the radial socket 22 to the casing 30, particularly the upper casing member 38 allows pivotal movement only within specific limits. In the preferred embodiment this angular opening is restricted to approximately 30 degrees which is sufficient to allow internal access, but not enough to cause structural damage if accidently left open permitting wind gusts to create movement striking the casing on the body.

Both the body 20 and casings 30 are formed from extrusions, preferably aluminum, in any length, with the maximum span limited only by the tooling available. The material may be any grade of aluminum that lends itself to this type of manufacturing technique. It has been found that the alloy 6063 in a T5 tempered condition is optimum for these extrusions, however, this in no way limits the type of aluminum or even the type of base material, as any substance having the required structural integrity would be equally applicable to this invention, such as magnesium or thermoplastic, etc.

Figure 2:
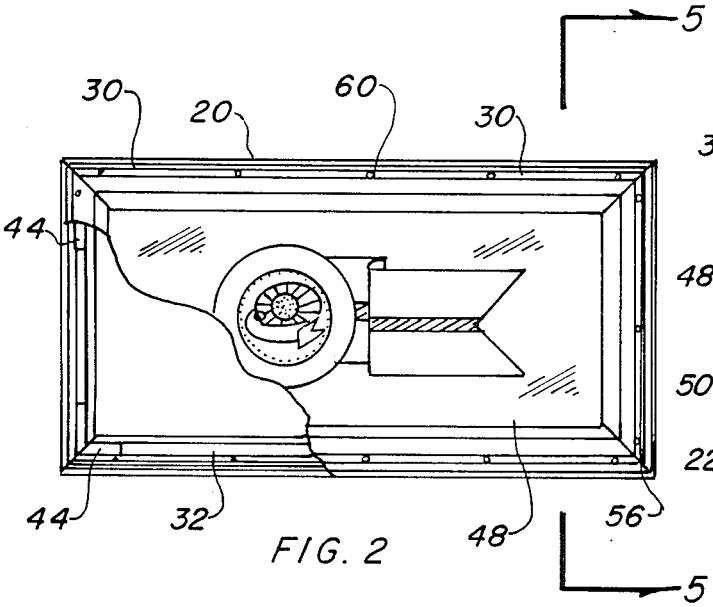
FIG. 2 is a side elevational view of the preferred embodiment with one corner cut-away illustrating the corner brackets and their relationship with the enclosing frame.
Figure 3:
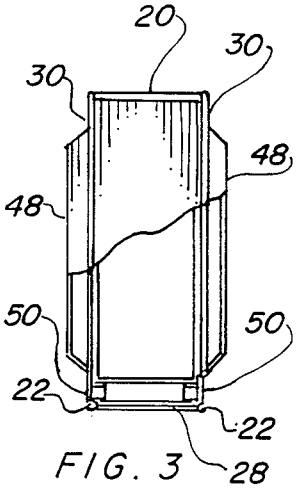
FIG. 3 is an end view of the preferred embodiment partially cut-away illustrating one of the angle brackets holding the body together along with the lighting means internal to the sign.
Figure 4:
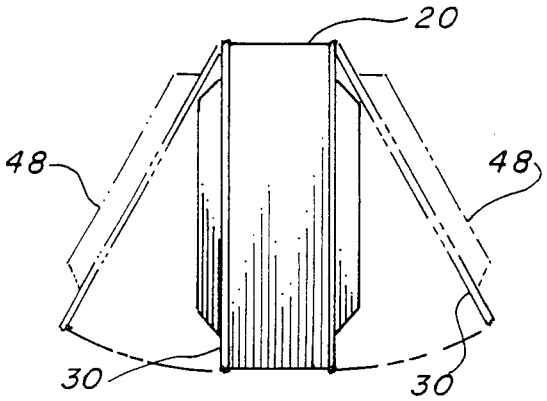
FIG. 4 is an end view of the preferred embodiment with the hinged sides shown in phantom in the open position depicting the access into the interior of the sign in order to change the fluorescent light tubes.
Figure 5:
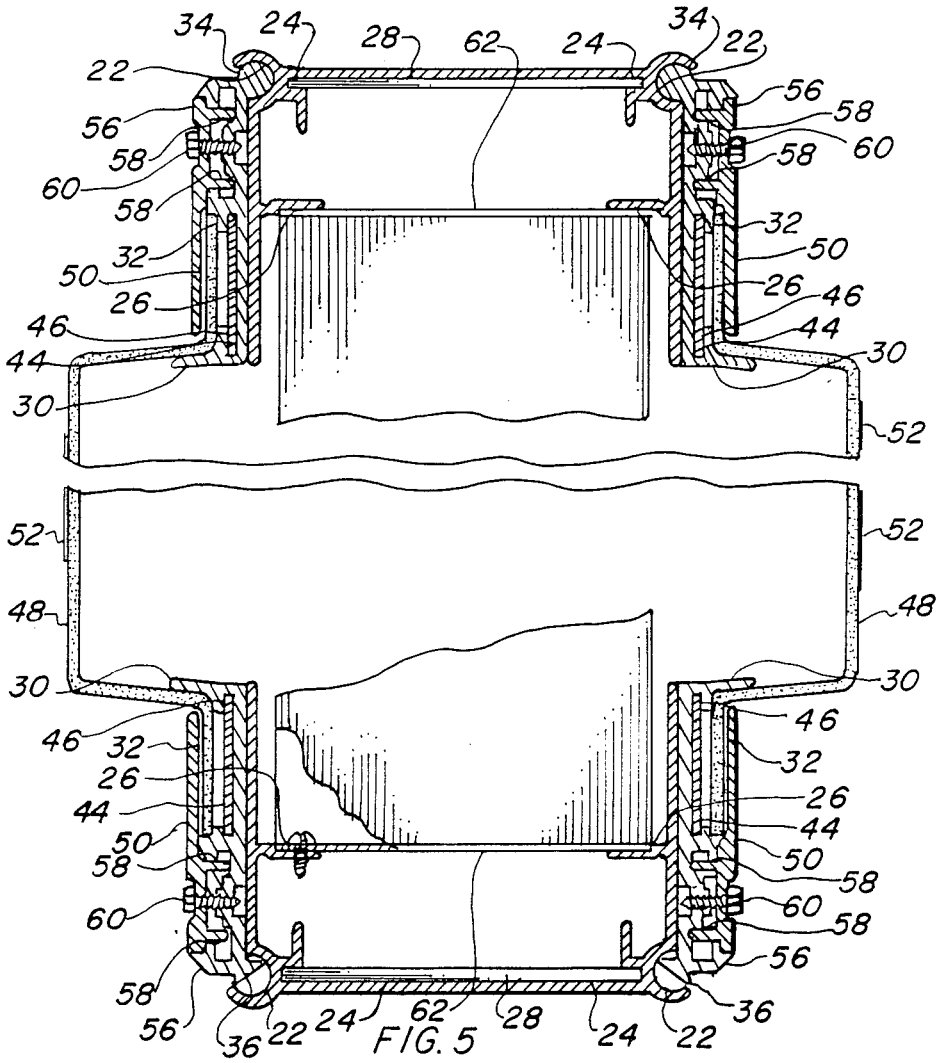
FIG. 5 is a cross-sectional view taken along lines 5—5 of FIG. 2 with the center portion cut-away to allow a large detailed cross-section of the invention to be illustrated.
Figure 6:
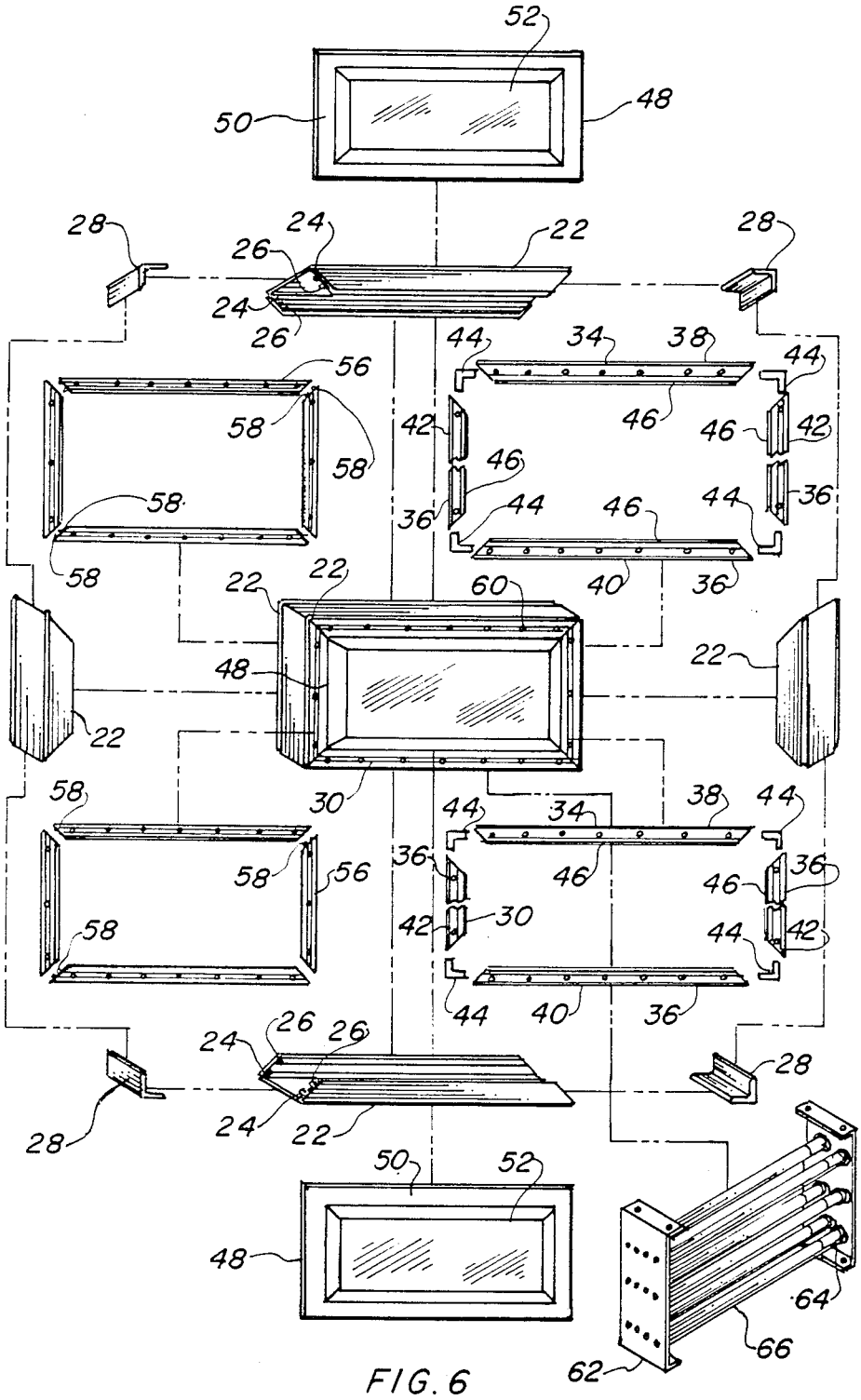
FIG. 6 is an exploded view of the invention illustrating all of the elements and their relationship to the assembly, shown in the center, with phantom lines directed to their relative position within the invention.
Figure 7:
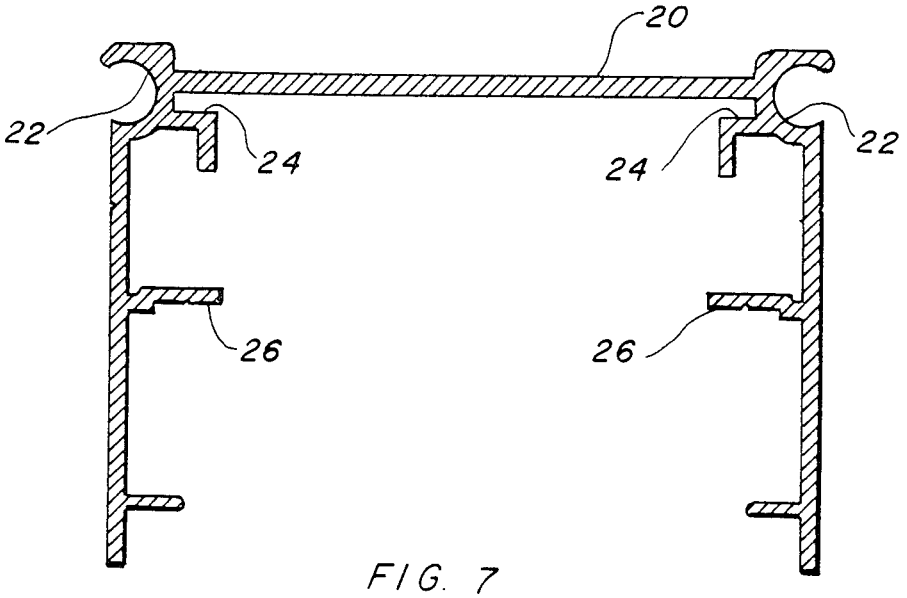
FIG. 7 is a cross-section of the rectangular body completely removed from the invention for clarity.
Figure 8:
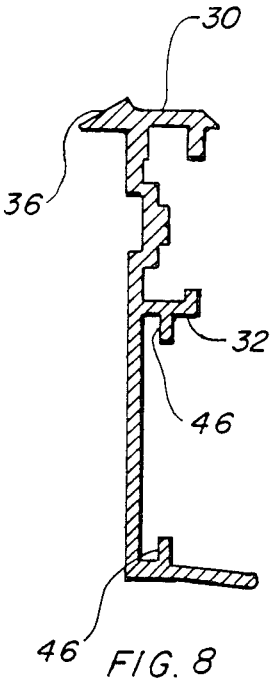
FIG. 8 is a cross-section of the lower or side casing member completely removed from the invention for clarity.
Figure 9:
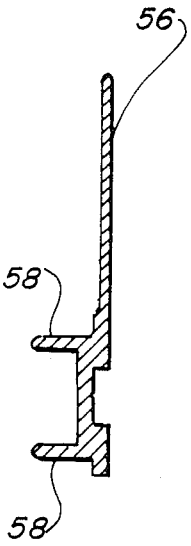
FIG. 9 is a cross-section of the retaining coping completely removed from the invention for clarity.
Figure 10:
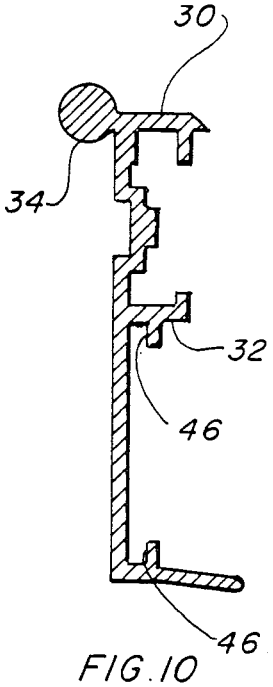
FIG. 10 is a cross-section of the upper casing member completely removed from the invention for clarity.

A pair of translucent faces 48 are mounted into the casing face recess 32, one on each side. The face 48 contains a peripheral flange 50 around the edge and a raised center portion 52. The face 48 is illustrated in FIGS. 1, 2 and separate in FIG. 6 and consists of a thermoplastic sheet that has been vacuum formed into a truncated shape. The material may be any acceptable formulation, such as polyethylene, phenylene oxide, polycarbonate, polypropylene, polystyrene, polyvinyl chloride, or the like. While vacuum forming is preferred, other types of manufacturing techniques may be used to produce the face, even the use of a thermoset plastic material is acceptable, provided the formulation is translucent enough to let sufficient light through to illuminate the sign from the inside.

Further, the sign includes indica 54 on the center portion 52 of the face 48 in the form of words, logos, pictures, or the like, including any combination thereof. The indica 54 may be the same color as the face 48, or may have an entirely different color than the base material, creating a distinctive message or logo recognizable from a distance to those viewing the sign. The indica 54 may also be formed in raised relief projecting above the outside of the surface to give depth distinguishing the message from the background, particularly at an extended viewing angle. Conversely, the indica 54 may also be recessed from the surface with equal ease in the vacuum forming process.

The face 48 is attached to the hinged casing 30 by a peripheral flange installed into the face recess 32 and an "F" shaped rectangular retainer coping 56 is placed thereover to completely captivate the face. The retainer coping 56 is also nested into the casing, as it contains a pair of inwardly depending spacer legs 58 creating the "F" shape with both legs extending the same distance. The legs 58 are contiguous with the casing and the balance of the coping 56 touches only the face preventing excess pressure from damaging the face flange 50. The joint is structurally formed with attaching means in the form of threaded fasteners 60, with hexagonal washer head self-drilling sheet metal screws being preferred, allowing dissembly for replacement of the face. The screws also allow threading back into the same holes for reassembly. As it may be seen, the removal of the face 48 is easy and intuitively obvious for the person accomplishing the repair, as the screws are in sight and are spaced a convenient 24 inches (61 cm) apart on each span on the longer signs. The coping 56 is constructed of extruded metal in the same manner and material as the body 20 and casing 30.

Lighting means inside the sign are provided by an electrically actuated light source making the sign visible at night and creating a pleasing appearance, particularly when the indica is colored and raised from the surface of the face. This lighting means may include any type of luminant, such as incandescent, vapor arc or fluorescent lights operating from an electrical source. The preferred embodiment is enclosed in a subframe 62 of a size to fit within the inwardly depending support legs 26 of the body 20 and is formed of sheet metal or constructed of structural metallic shapes, such as angles or channels, either fastened or welded together. In any event, the sub frame 62 provides a mounting surface for a plurality of lamp fixtures 64 that connect to the lamps. While any lamp will function properly, the preferred embodiment utilizes fluorescent lamps 66 that are removably attached between the lamp fixtures 64, one on each end, placed in banks the appropriate distance apart according to the size of the sign. The lamps 66 are connected to a power source with wiring means well known in the art and transmit power from the source to the sign itself.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. An illuminated sign with integral hinged sides comprising:

(a) an extruded U-section shaped rectangular body having a first side and a second side and having a radial socket along an outer edge of both the first and second side, also a pair of internal recessed angle receiving grooves and a pair of inwardly depending support legs, said body formed into a rectangle having mitered corners, defining a structural frame;

(b) a plurality of angle brackets, one on each corner, so configured as to slideably engage said angle receiving grooves in said body creating a structurally reinforced corner;

(c) a pair of rectangular hinged casings, slightly smaller in girth than said body having a face recess and an outwardly extending radial protuberance along a top edge and an outwardly extending pointed lip on the remaining edges, the radial protuberance slightly smaller in diameter than the body radial socket and pivotally positioned therein allowing the casings to be retained and hinge outwardly from the body for access inside;

(d) integral self-latching means characterized by said outwardly extended pointed lips on the perimeter of the casing, contiguously engaging the body radial socket on the edge of both the first side and the second side retaining the casings in place by frictional resistance while allowing opening thereof by utilizing a slight bending moment of the body radial socket creating a snap acting closure;

(e) a pair of translucent faces, one on each side of the sign having a peripheral flange and a raised center portion with the flange embracing the face recess of the casing, the face providing a message in the form of a design or indica on the center portion thereof visible from a distance;

(f) a pair of "F" shaped rectangular face retaining copings nested into said hinged casing joined together with attaching means each coping having a pair of inwardly depending spacer legs of a configuration that overlaps said peripheral flange of the translucent face, retaining the face between the coping and the hinged casing in a removable manner allowing the face to be replaced if damaged; and, (g) lighting means inside the sign providing an electrically actuated light source creating the illumination necessary to make the sign visible from a distance at night and to provide a pleasing appearance through the translucent face distinctly outlining a design or indica positioned thereupon.

2. The illuminated sign as recited in claim 1 further comprising, a weld joint at the intersection of said angle bracket and the angle receiving grooves in said body creating a permanent fixed bond therebetween causing the U-section shaped body formed in a rectangle of extruded members with mitered corners to become an integral fixed permanent element.

3. The illuminated sign as recited in claim 1 wherein each rectangular hinged casings further comprise, an upper and lower casing member of extruded material and a pair of side casing members each mitered at the ends thereof forming corners and a plurality of flat "L" shaped corner brackets, one for each mitered corner, nested contiguously into said casing members forming a reinforced joint at each mitered corner, said corner brackets further having a welded permanent connection therebetween creating a rigid structural casing capable of retaining the face and coping while being hinged for access.

4. The illuminated sign as recited in claim 1 wherein said translucent face further comprises, indica having a color different than the base material of said face creating a distinctive message or logo recognizable to those viewing the sign.

5. The illuminated sign as recited in claim 4 wherein said indica further comprises, vacuum formed raised letters and figures projecting above the outside surface of the face to give depth, distinguishing the indica from an extended viewing angle.

6. The illuminated sign as recited in claim 1 wherein said attaching means for joining said coping to said casing further comprise, threaded fasteners having hexagonal heads capable of being installed and removed with hand held tools.

7. The illuminated sign as recited in claim 1 wherein said lighting means further comprise:

(a) a subframe of a size to fit within said inwardly depending support legs formed of a metallic substance;

(b) a plurality of lamp fixtures mounted on to said subframe in alignment one with the other on opposed ends;

(c) a plurality of fluorescent lamps removably attached into said lamp fixtures providing a light source for sign illumination; and, (d) wiring means connecting said fluorescent lamps to a power source providing a means to transmit electrical energy from an external source to the illuminated sign.

* * * * *